US008147383B2

(12) United States Patent
Bentley

(10) Patent No.: US 8,147,383 B2
(45) Date of Patent: Apr. 3, 2012

(54) VAULTING POLE WITH ALIGNMENT DEVIATION

(76) Inventor: William Childress Bentley, Tomball, TX (US)

( * ) Notice: Subject to any disclaimer, the term of this patent is extended or adjusted under 35 U.S.C. 154(b) by 0 days.

(21) Appl. No.: 12/901,514

(22) Filed: Oct. 9, 2010

(65) Prior Publication Data

US 2011/0092338 A1 Apr. 21, 2011

Related U.S. Application Data

(60) Provisional application No. 61/248,416, filed on Oct. 21, 2009, provisional application No. 61/291,816, filed on Dec. 31, 2009.

(51) Int. Cl.
*A63B 5/06* (2006.01)

(52) U.S. Cl. ..... 482/18

(58) Field of Classification Search ..... 482/14–18; 135/65, 77, 80, 82, 84, 86; 280/819
See application file for complete search history.

(56) References Cited

U.S. PATENT DOCUMENTS

| | | | | |
|---|---|---|---|---|
| 5,058,923 | A * | 10/1991 | Dale | 280/821 |
| 5,087,076 | A * | 2/1992 | Fagot et al. | 280/819 |
| 5,236,223 | A * | 8/1993 | Leon et al. | 280/821 |
| 5,331,989 | A * | 7/1994 | Stephens | 135/65 |
| D407,457 | S * | 3/1999 | Garcia | D21/775 |
| 5,904,167 | A * | 5/1999 | Moye | 135/65 |
| 6,267,686 | B1 * | 7/2001 | Legacie, Jr. | 473/44 |
| 7,222,633 | B1 * | 5/2007 | Werner, III | 135/65 |
| 7,434,592 | B2 * | 10/2008 | Larson et al. | 135/73 |
| 2001/0032662 | A1 * | 10/2001 | Battiston | 135/69 |
| 2003/0227167 | A1 * | 12/2003 | Redor et al. | 280/819 |
| 2004/0107981 | A1 * | 6/2004 | Smith | 135/65 |
| 2004/0250845 | A1 * | 12/2004 | Rudin et al. | 135/77 |
| 2008/0223424 | A1 * | 9/2008 | Hollier | 135/71 |
| 2010/0024857 | A1 * | 2/2010 | Larson et al. | 135/72 |

OTHER PUBLICATIONS

Athletics Oustanding Performer—The Vaulting Pole, vol. 9, No. 1, Summer 2002.*
Arresting Vaulting Pole Technology, Russ VerSteeg, vol. 9:93, Vanderbilt J. of Ent. & Tech. L.*
Patent Dialog Search.*
NPL Full Text Search.*
Bob Seagren, Barred from using banana pole.*
Aug. 22, 1975, The Citizen, Ottawa, p. 20, Banana Vaulting Pole Okayed for Olympics.*
NPL Bibliographic Search.*
Inventor Seach.*

* cited by examiner

*Primary Examiner* — Loan Thanh
*Assistant Examiner* — Daniel Roland
(74) *Attorney, Agent, or Firm* — Harrison Law Office, PC

(57) ABSTRACT

A vaulting pole apparatus having a predetermined angular displacement at an end of a vaulting pole, attributable to the vaulting pole being constructed with an inherent structural deviation located along and offset from its longitudinal axis. The vaulting pole may be constructed with a fixed structural deviation or with a removable structural deviation, wherein an end of the vaulting pole deviates or is offset from the vaulting pole's central longitudinal axis. Embodiments of this structural deviation may be fixed during vaulting by a vaulter athlete or may be adjustable by a vaulter athlete in real-time or near-real-time.

22 Claims, 5 Drawing Sheets

VAULTING POLE WITH ALIGNMENT DEVIATION

RELATED APPLICATIONS

This application claims priority based upon U.S. Provisional Application Ser. No. 61/248,416 filed Oct. 21, 2009 and U.S. Provisional Application Ser. No. 61/291,816 filed Dec. 31, 2009.

FIELD OF THE INVENTION

The present invention relates to pole vaulting and more particularly relates to a vaulting pole constructed with an inherent structural deviation located along, and offset from, its longitudinal axis, for providing a vaulter with a vaulting pole having a predetermined angular displacement of one end thereof.

BACKGROUND OF THE INVENTION

The pole vault is a demanding athletic event requiring a combination of sprinting, jumping, and gymnastics. In the course of engaging in a pole vault, a vaulter athlete initially sprints down a runway carrying a suitable pole, with an objective of arriving at the vault takeoff box with maximum attainable speed. Once the takeoff box is reached, the vaulter athlete emplaces or "plants" the vault pole into the takeoff box, and immediately thereafter executes a running-jump that causes the vaulter athlete to become airborne and to be thrust upwardly. Next, the vaulter's momentum causes the pole to commence bending, whereupon the vaulter athlete and vaulting pole synchronously rotate about the takeoff box.

As will be appreciated by those skilled in the vaulting art, during the vaulter athlete's sprint down the runway, subsequent plant of the vaulting pole in the takeoff box, and consequent upward thrust, the initial kinetic energy generated during the vaulter athlete's run-up to the takeoff box is transformed into potential energy, which is ultimately manifest as the height reached by the vaulter athlete.

It will be understood that, as the vaulting pole bends and then recoils, the vaulter athlete is caused to rotate about the shoulders, and then preferably pull up on the vaulting pole in order to be thrust to a maximum height with the goal of passing over the crossbar with the vaulter's feet leading this ascent. While the peak height achieved by the vaulter athlete is attributable primarily to the kinetic energy engendered during the run-up, there are substantial energy losses that unavoidably occur during the pole plant and vaulter athlete's takeoff.

Vaulting poles are structured and manufactured for the purpose of propelling a vaulter athlete over a fixed elevated horizontal crossbar during a pole vault sports competition. The physical characteristics of a vaulting pole are crucial in order that a vaulter athlete may obtain maximum vaulting height. Interestingly, the International Amateur Athletic Federation has no particular rules pertaining to, or restrictions of, such vault pole characteristics as pole length, vault pole materials of construction, or a vault pole's energy storage capacity.

It is well known in the art that vaulting poles are manufactured substantially in a linear configuration from various lightweight materials that progressed from bamboo to aluminum to fiberglass, carbon fiber, and plastics—and composites thereof. Prior art attempts to improve athletes' ability to achieve higher pole vaults have heretofore focused on modifying vaulting pole materials of construction and methods of pole manufacture. For example, materials of construction such as fiberglass and carbon fiber composites are commonly chosen materials that are typically arranged in a plurality of layers that constitute popular contemporary vaulting poles.

During a pole vault competition, a vaulting pole must afford the ability to absorb all of a vaulter athlete's energy manifest while the vaulting pole is being caused to bend—in the course of a vaulter athlete proceeding apace down the runway and then planting the remote edge of the vaulting pole into the vault box. The vaulting pole should ideally return substantially all of this energy while it is being caused to resume its straight or linear configuration—as the vaulter athlete is propelled upwardly toward the pole vault crossbar. Contemporary vaulting poles are designed not only to waste minimal energy while bending, i.e., to convert maximum kinetic energy into potential energy during the vault, but also are designed to be structured from components having an especially advantageous strength-to-weight ratio.

As is also known in the pole vaulting art, heightened vaults may be achieved by vaulter athletes running apace during the approach down the runway to the vaulting pit, thereby engendering substantial kinetic energy. As is common in the art, vaulters seek to maximize accumulation of kinetic energy by regularly participating in sprint training to increase runway speed. Coaches strive to maximize vaulters' ability to marshal kinetic energy by continuing to seek opportunities to reduce vaulting pole weight, and/or by striving to match vaulting pole attributes with a vaulter athlete's strength and interdependent physical characteristics. Besides judicious selection of materials of construction and layered configuration thereof, and proper hand grip, weight rating, "Flex Number"—as measured by the tendency of a pole to bend or flex under load, with a more flexible pole having a higher Flex Number, and pole weight, vaulting pole improvements known in the art have also invoked a "sail piece" design that tends to provide loop strength as well as to alter a vaulting pole's bending moment by incorporating a rigid portion therewithin. It will be appreciated that vaulting poles common in the art have been designed for specific vaulter athlete weight classes in order to achieve optimal vault pole bending, which is, in turn, is functionally related to maximum attainable height above the pole vault crossbar. It will, of course, be understood by those skilled in the art that particular pole vault techniques invoked by a vaulter athlete also factor into the maximum attainable height equation.

The physical characteristics of the pole are an important factor in a attaining optimal pole vaulting performance. International Amateur Athletic Federation rules do not place any restriction on vault pole length, materials of construction, or inherent vault pole energy storage capacity. The majority of vault poles are manufactured on tapered mandrels. It appears that most world-class male pole vaulters rely upon fibreglass or carbon fibre poles that are 5.00±5.20 m long. These vault poles have been observed to withstand bending of more than 120° without breaking, and have been observed to store an amount of elastic strain energy equivalent to about one half of an athlete's run-up kinetic energy.

It appears that, in spite of investigations and experimentation involving pole vaulting attributes and consequent performance, the various associated qualitative and quantitative relationships are still not well understood. These underlying relationships include such factors as athletes' speed and strength—and relationship therebetween, vaulting pole characteristics, and techniques invoked by athletes during pole vaulting. Implicated in this analysis of underlying pole vaulting principles are such factors and considerations as the functional relationship between takeoff angle and takeoff velocity, and the minimization of energy losses associated with vault pole plant and subsequent takeoff.

It should be clear to those skilled in the art that the plethora of vaulting techniques, in conjunction with athletes' selection of vaulting poles, affects the efficiency of converting kinetic energy to potential energy when the vaulting pole is planted. Then, as the vaulting pole is caused to bend, kinetic energy is absorbed akin to compressing a spring. The vaulter athlete invokes potential energy stored in the vaulting pole to urge the vaulter's body to be raised above the crossbar. Whether the highest point achieved during the vault traverses the crossbar is known in the vault art to be a function of the percentage of the pole's kinetic energy that has been converted into potential energy.

Notwithstanding these developments and refinements in the pole vaulting art, there appears to be no apparatus which has considered constructing a vaulting pole with a built-in alignment deviation. It has been found to be advantageous for a vaulter athlete to invoke a vaulting pole apparatus that inherently affords several benefits attributable to the presence of a longitudinal axis alignment deviation contemplated by the present invention. Accordingly, these limitations and disadvantages of the prior art are overcome with embodiments of the present invention, wherein a vaulting pole is constructed with an alignment deviation which provides vaulter athletes prerequisite apparatus for achieving higher pole vault heights than heretofore achieved. It has been found that embodiments of the present invention simultaneously enable vaulter athletes to benefit from optimal ergonomic conditions which tend to both maximize attainable pole vault height and to minimize injury to vaulters' wrists and implicated bones, joints, and related tissue.

Heretofore unknown in the prior art, the present invention incorporates an angular deviation away from a vaulting pole's lengthwise dimension for increasing the vaulting pole plant angle and for providing an inherently ergonomic hand grip throughout a pole vault. Accordingly, it should be understood that embodiments of the present invention may be constructed from virtually any material or combination of materials that are lightweight, that waste minimal energy during bending and recovery, and that afford an advantageous strength-to-weight ratio.

SUMMARY OF THE INVENTION

The present invention provides an apparatus having an angular displacement at an end of a vaulting pole, attributable to the vaulting pole being constructed with an inherent structural deviation located along and offset from its longitudinal axis. As will become clear to those skilled in the art, the instant vaulting pole may be constructed with either a fixed structural deviation or with a removable structural deviation, wherein an end of the vaulting pole deviates or is offset from the vaulting pole's central longitudinal axis. It is contemplated that embodiments may be configured with a real-time or near-real-time in situ adjustable deviation that handily achieves the plethora of benefits that flow from the teachings herein. It is further contemplated that any structural deviation implemented either on a permanent basis or on an ad hoc basis, for the purpose of being suitable for use by a particular vaulter athlete, falls within the scope of the present invention.

It is a feature of embodiments of the present invention that the angle of impact is increased when a vaulting pole is planted within a receiving box.

It is another feature and advantage of embodiments of the present invention that a vaulter athlete may achieve greater pole vault heights than would otherwise be possible using conventional vault poles.

It is another feature of embodiments of the present invention that a vaulter athlete may sustain a more ergonomic grip throughout pole vault routines effectuated during practice sessions or during competition.

It is a feature and advantage of embodiments of the present invention that a vaulter athlete may sustain a more ergonomic and secure handhold when pulling up on the vertical axis thereof during pole vault routines and, in so doing, assisting align the vaulter athlete's body with the vaulting pole.

It is yet another feature and advantage of embodiments of the present invention that vaulter athletes may sustain a more ergonomic and secure handhold when pushing away and upward therefrom upon completing pole vault routines.

It is still another object and feature of embodiments of the present invention to safely maximize energy transfer while vaulter athletes are engaged in pole vaulting routines.

It is an object of the present invention to safely maximize energy transfer efficiencies, wherein kinetic energy generated while vaulter athletes run down runways is transformed into potential energy stored within embodiments of the instant vaulting pole, and, subsequently, transformed back into kinetic energy thereby propelling vaulter athletes toward and ideally over the crossbar.

It is a feature of the present invention that energy transfer efficiencies are safely maximized, wherein vaulter athletes may utilize vaulting poles of greater rigidity than would otherwise be considered safe by invoking conventional vaulting poles.

It is a feature and advantage of the present invention that energy transfer efficiencies may be safely maximized, wherein vaulter athletes may utilize vaulting poles of greater length than would otherwise be beyond a vaulter's limitations and what would ordinarily be considered safe when a vaulter invokes a conventional vaulting pole.

These and other objects of the present invention will become apparent from the following specifications and accompanying drawings, wherein like numerals refer to like components.

DETAILED DESCRIPTION

Reference is made herein to the figures in the accompanying drawings in which like numerals refer to like components.

Figure 1:
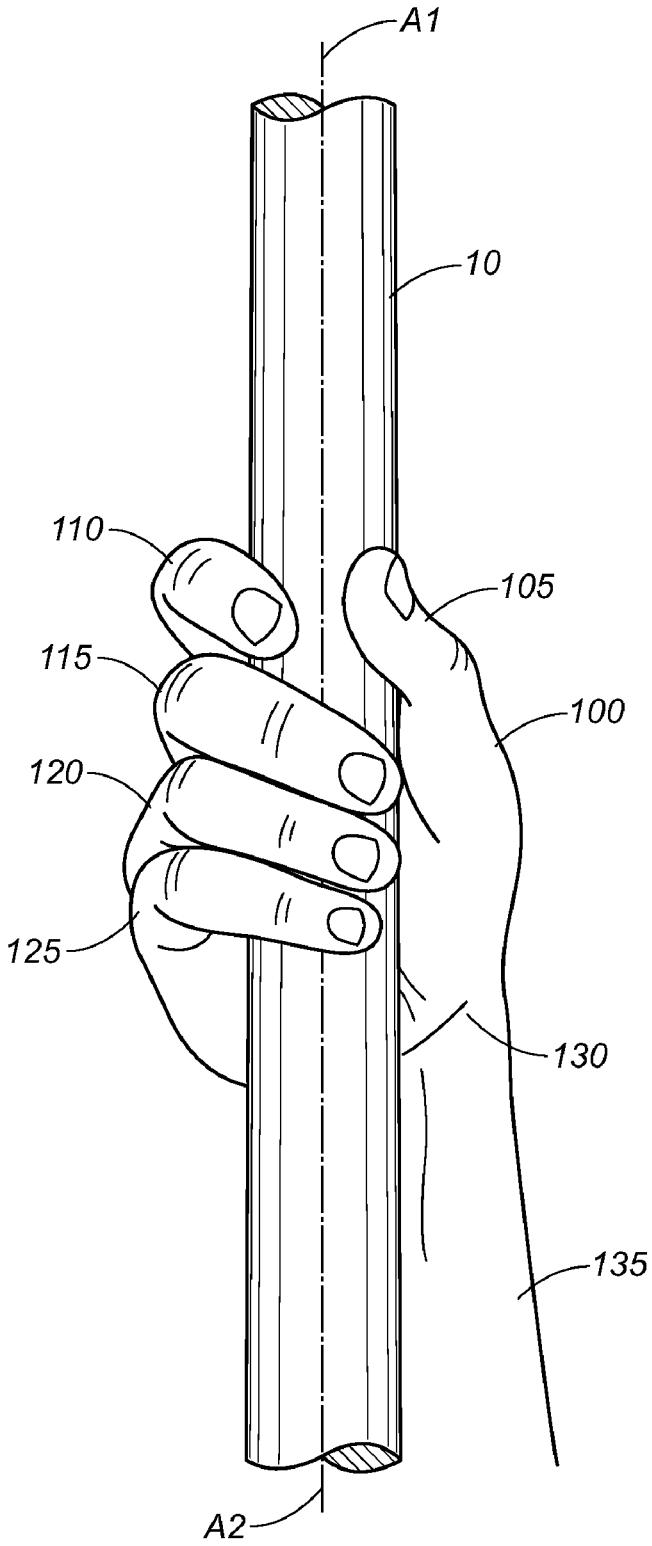
FIG. 1 depicts a frontal perspective view of a portion of a prior art embodiment of a vaulting pole being gripped in a vaulter's hand.
Figure 2:
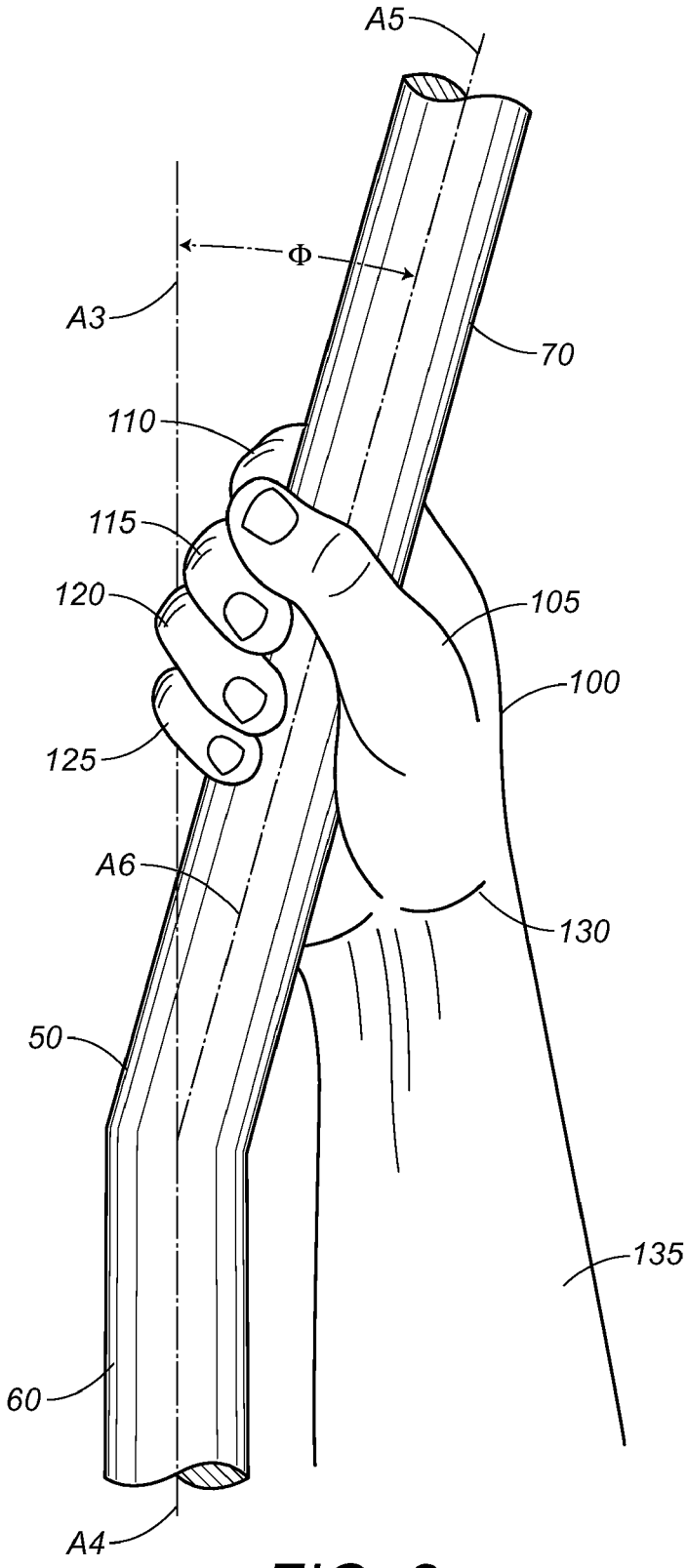
FIG. 2 depicts a frontal perspective view of a portion of a vaulting pole embodiment of the present invention being gripped in a vaulter's hand.
Figure 3:
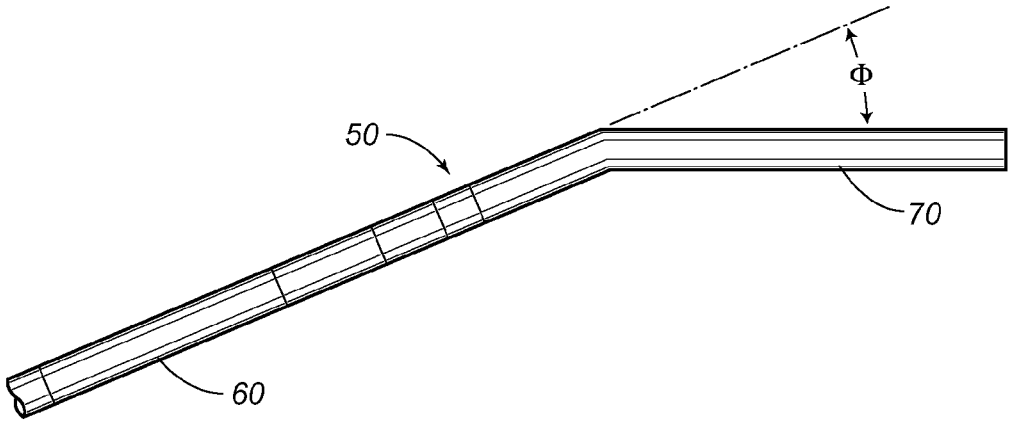
FIG. 3 depicts another frontal perspective view of the portion of the vaulting pole embodiment depicted in FIG. 2.
Figure 4:
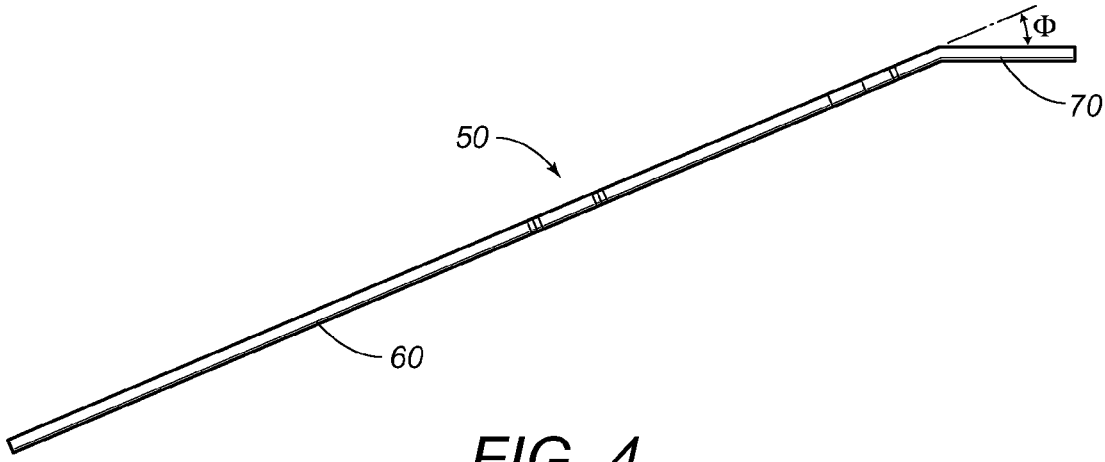
FIG. 4 depicts another frontal perspective view of the entire vaulting pole embodiment corresponding to the portion thereof depicted in FIG. 3.

Now referring collectively to FIGS. 1 and 2, there are depicted two contrasting vaulting poles indicative of, in turn, a conventional embodiment known in the art and of embodiment of the present invention. More particularly, FIG. 1 depicts a conventional vaulting pole 10 with its body portion 20 configured to be parallel to or linearly aligned with its center longitudinal axis A1-A2 in a manner well known in the art. FIG. 2, by contrast, depicts a vaulting pole embodiment of the present invention 50 configured with a body portion 60 disposed parallel to or linearly aligned with its center longitudinal axis A3-A4 and a contiguous offset portion 70 configured to be parallel to or linearly aligned with its offset axis A5-A6. As depicted in FIG. 2, offset axis A5-A6 is disposed at angle Φ° relative to longitudinal axis A3-A4.

That is, as will be described in detail, instant vaulting pole embodiments of the present invention differ from conventionally configured vaulting poles on the basis of vaulting poles being structured with an offset portion 70 offset Φ° from the central or lengthwise body portion 60. Still referring to FIGS. 1 and 2, a vaulter athlete's right hand 100 including five jointly interconnected five fingers: 105 (thumb), 110 (pointer or index finger), 115 (middle finger), 120 (ring finger) and 125 (pinky or little finger) is depicted grasping vaulting pole portions 10 and 50, respectively, and interconnected, in turn, with the vaulter athlete's pivotally attached wrist 130 which is, in turn, contiguously interconnected with the vaulter athlete's forearm 135.

While there have been considerable efforts in the art to improve vaulting poles, wherein athletes may consistently vault to new, higher heights using advanced and newly-developed combinations of materials of construction, and incorporating sail-piece designs for effecting bending moments, none of these improvements in the vaulting art has addressed the use of a nonlinear vaulting pole, i.e., use of a vaulting pole structured with an angular deviation or offset from the longitudinal axis, with the offset disposed at one end thereof. It has been found that this offset configuration inherently increases the vaulting pole angle and also affords a vaulter athlete an ergonomic hand grip as will be hereinafter described. Indeed, as is well-known in the art, vaulting poles have heretofore been routinely aligned linearly—without exception to a standard straight, linear configuration.

Notwithstanding this well-established standard pole configuration in the pole vault art, it has been found that implementing a vaulting pole with a structural deviation ϕ° offset from the longitudinal central axis, as depicted in FIGS. 2-6, affords several inherent and surprising benefits heretofore unknown to vaulter athletes and pole vaulting coaches alike, and to both vaulting pole designers and manufacturers. Significantly, presence of the instant structural deviation depicted in FIGS. 3 and 4 for a portion of a preferred embodiment of the instant vaulting pole and for the entire vaulting pole, respectively, tends to increase the angle which is manifest by the vaulting pole when the vaulter athlete plants the vaulting pole tip in the receiving box during pole vault training or competition.

Figure 5:
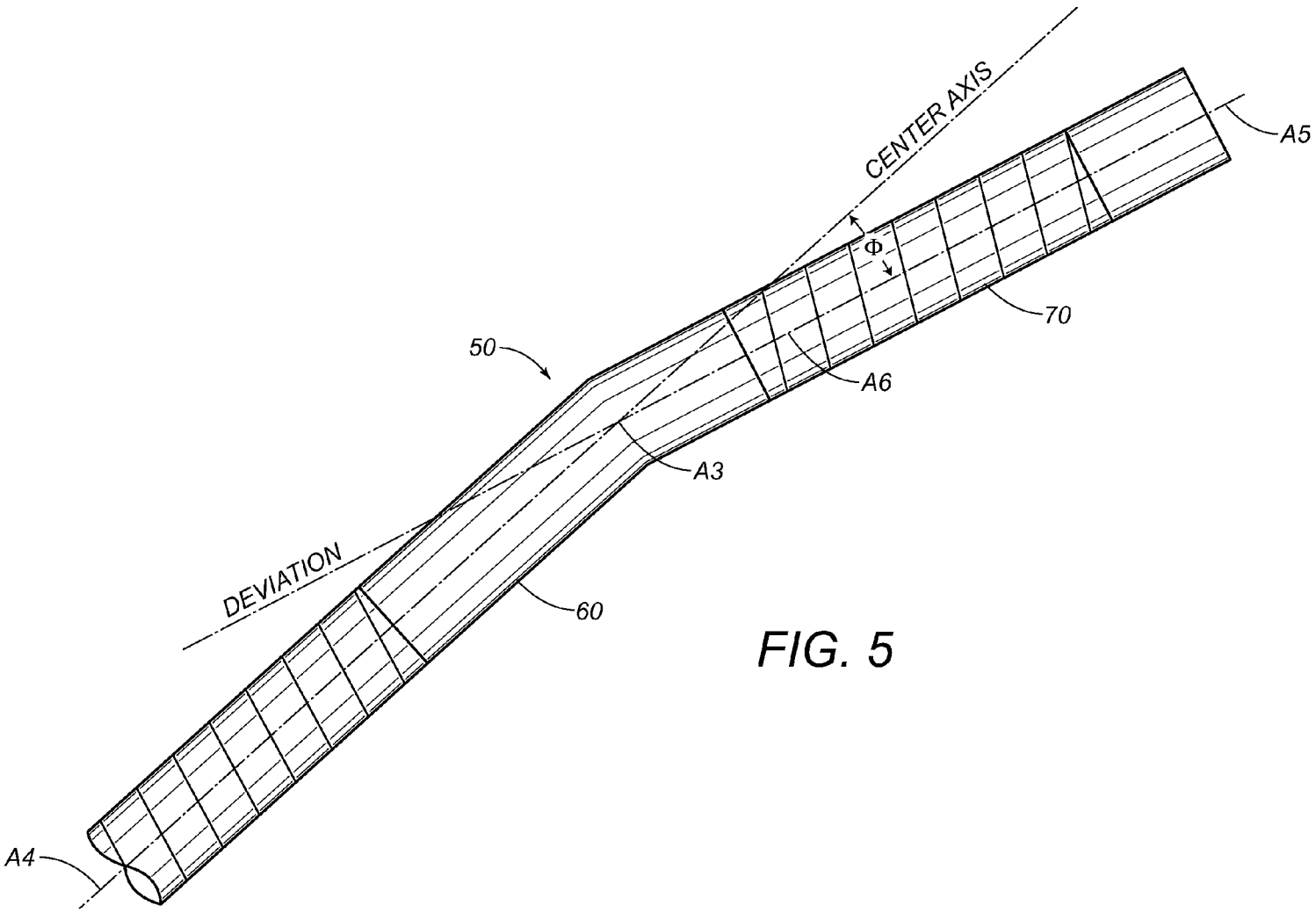
FIG. 5 depicts a frontal view of the portion of the vaulting pole embodiment depicted in FIG. 2, having a permanent deviation end.
Figure 6:
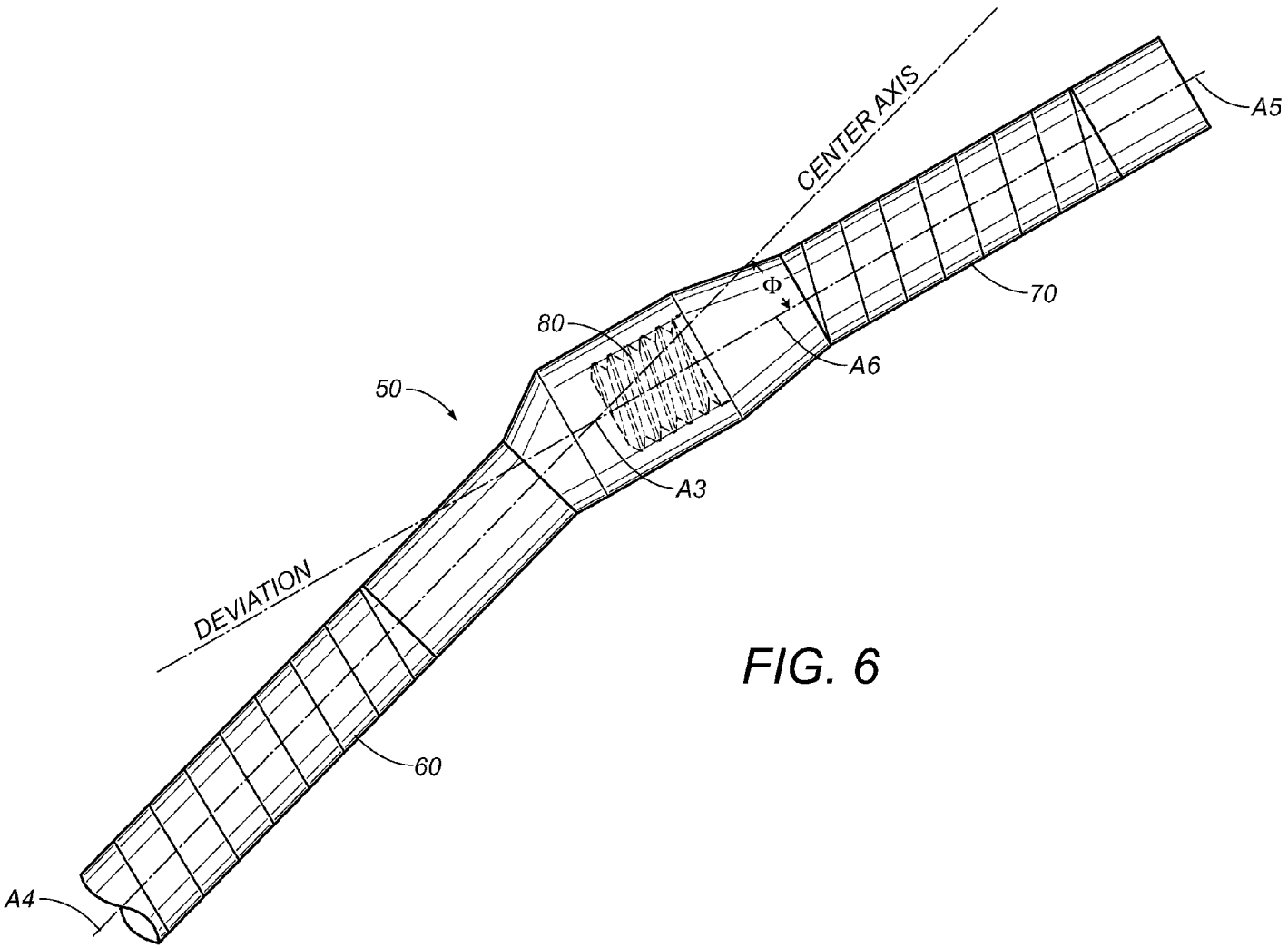
FIG. 6 depicts a frontal partial cut-away view of the portion of the vaulting pole embodiment depicted in FIG. 2, having a removable deviation end.

Two alternative embodiments of the vaulting pole of the present invention are depicted in FIGS. 5 and 6. The embodiment depicted in FIG. 5 corresponds to a vaulting pole 50 with offset portion 70 disposed at offset angle ϕ° and permanently affixed to contiguous axial body portion 60. On the other hand, the embodiment depicted in FIG. 6 corresponds to vaulting pole 50 with the offset body portion 70 disposed at offset angle Φ° and removably affixed to axial body portion 60. While this particular removable embodiment depicts the offset body potion screwably attached to the contiguously disposed axial body portion 60, it should be clearly understood that any removable attachment or interconnection methodology known in the art may be used to accomplish this contemplated joinder between the vault pole body portion 60 and offset portion 70.

It will be understood by those skilled in the sport of pole vaulting that, based upon fundamental biomechanical principles, when a straight linear object such as a baseball bat or a golf club is hand-held parallel to a person's forearm, there is maximum stress imposed upon the person's forearm muscles and the wrist infrastructure. Furthermore, this parallel protocol for holding a straight or linear object also inherently affords the weakest grip securing this straight object.

Contrariwise, if such a straight object were hand-held perpendicular to a person's forearm, there is minimum stress imposed upon the person's forearm muscles and the wrist infrastructure. Furthermore, this perpendicular protocol for holding a straight or linear object also inherently affords the strongest grip securing this straight object.

Applying such biomechanical principles, vaulting pole embodiments of the present invention are configured with a deviation offset at an offset angle ϕ° with respect to a vaulting pole's longitudinal axis so that when hand-held by a vaulter athlete the grip quality and security tends to be more akin to a stronger perpendicular protocol—wherein the vaulter athlete's hand-wrist-forearm combination is linearly arranged relative to the vaulting pole—than a weaker parallel protocol—wherein the vaulter athlete's hand-wrist-forearm combination is perpendicularly arranged relative to the vaulting pole.

It should be appreciated that when an otherwise conventionally straight vaulting pole is structured with an offset angle Φ°, the gripping strength and security thereof tend to increase and asymptotically approach the strength of a perpendicular relationship between a vaulter athlete's hand-wrist-forearm and vaulting pole. The optimal displacement or deviation Φ° for a particular vaulter varies with an athlete's vaulting style and nuances thereof, and, of course, the athlete's height, weight and strength. By configuring a vaulting pole with a deviation from its central longitudinal axis, the vaulter athlete's wrist would be situated in considerably less extended position than if and when the athlete were invoking a conventional vault pole. It should be evident that this deviation protocol of the present invention results in a more ergonomic wrist position than would otherwise be possible, thereby enabling the athlete to effectuate a stronger handgrip on the vault pole and simultaneously engender more powerful forces exerted by the athlete.

While performing a vault maneuver, a vaulter athlete attempts to position the body in an inverted and linear disposition relative to the vault pole. Interestingly, the athlete is orchestrating this maneuvering while the pole is "relaxing"—in the throws of straightening itself out after being bent during the takeoff. As will be understood by those skilled in the art, the athlete commences this crucial maneuver by first swinging the lower body portion upwardly until the feet are situated above the athlete's head, whereupon the athlete is in a position for handholding the pole's upper portion proximal to the ankles. From this "jack-knifed" position, the vaulter athlete is required to straighten the body by pulling upon the vault pole and sustaining its position adjacent to and in line with the body. Simultaneously, the wrist of the athlete's upper hand is fully extended and the handgrip is situated in a parallel relationship with the athlete's forearm. It will be appreciated that such a disposition would correspond to the weakest position of the vaulter athlete's handgrip for securely holding the vault pole. On the contrary, the athlete's strongest wrist disposition would correspond to the vaulter athlete's handgrip being perpendicular to the forearm.

Accordingly, embodiments of the present invention having an structural deviation from the centerline of the vaulting pole, tend to inherently situate the athlete's wrist in a less extended position, thereby featuring an ergonomic wrist condition associated with a stronger handgrip and concomitant more powerful forces exerted by the vaulter athlete in the process of pulling the athlete's body into the straightened, inverted disposition relative to the vaulter pole. While performing such a pole vault maneuver, after the pole is fully extended, the vaulter athlete is immediately thrust or vaulted off the ground. The athlete now has the benefit of being able to amplify such a vault by pushing off the proximal end of the pole. Ergo, the structural deviation has enabled the athlete's pushing-hand to be rendered more convenient and efficient as hereinbefore described.

It is known in the pole vault art that energy is transformed from kinetic energy to potential energy as an athlete's momentum developed during the runup is transferred to the pole plant in the rear of the receiving box. The most efficient energy transfer occurs when the transfer is disposed in directly opposing directions. That is, in the pole vault, since the vault pole tip provides a fixed fulcrum, the direction of energy transfer is offset in a direction in which the vault pole is allowed to rotate about a fixed point. Therefore, redirecting the energy in a more downwardly direction under the influence of the deviation taught by embodiments of the present invention, even by only a few degrees, effects a more efficient transfer of potential energy into the vault pole.

It has been found that the greater the vault pole angle that a vaulter athlete can achieve during a pole vault—at the instant the runup is completed and the pole is immediately planted in the receiving box, then the greater the athlete's ability to move the vault pole in the intended direction, i.e., toward the landing pit. It should be appreciated that an optimum vault pole angle exists that tends to maximize potential energy generated by action of an athlete during a pole vault activity. The acceptable range for a vaulter athlete to accommodate a pole with an increased angle is a function of the length and stiffness of a pole in view of the athlete's physical characteristics and concomitant capabilities including sprint speed. As should be readily understood by those conversant with the art, vault pole angle has historically been constrained by pole length coupled with a vaulter athlete's height and associated reaching ability. As taught herein, however, a vaulter athlete may obtain significant benefit from invoking a vault pole constructed with a deviation angle that is manifest as a proportionally greater plant or takeoff angle.

Other things being equal, as a bright line but as a limitation of the scope of the present invention, for certain vaulter athlete's, it has been projected and extrapolated that the offset angle $\phi°$ should preferably be in the range 5-41° in order to achieve the superior pole vault performance contemplated hereunder. Then again, for other vaulter athlete's, it has been likewise projected and extrapolated that the offset angle $\Phi°$ should preferably be in the range 5-21° in order to achieve the superior pole vault performance contemplated hereunder.

More preferably, the offset angle $\phi$ should be in the range 10-18° in order to achieve optimal pole vault performance contemplated hereunder. Offset angles in the range 22-25° have been found to be too large to enable a vaulter athlete to properly handle an elongated vaulting pole with a typical combination of stiffness and flexibility characteristics, as contemplated herein and as enabled according to the teachings hereunder.

It will be understood that this increased angle is formed from the end or tip of the pole opposite the vaulter athlete's handhold at the time the pole is planted in the box at the commencement of a vault. That is, one side of the angle is formed by the pole when extending a line through the center longitudinal axis of the vaulting pole for the majority of its length; the other side of the angle is formed by extending a line from the end or tip of the vaulting pole, disposed parallel to the ground and extending to the vaulter athlete's footing prior to leaving the ground.

It will be appreciated that increasing the angle of a vaulting pole at the commencement of a vault reduces the effort necessary for the vaulter athlete to transfer engendered kinetic energy—proportional to the product of the vaulter athlete's mass and the square of the vaulter athlete's runway speed—into the potential energy of the vaulting pole disposed in a bent condition. This increased vaulting pole angle also enables maneuvering the vaulting pole in an arcing manner that tends to lift the vaulter athlete off the ground and thereby effectuate the vaulter athlete being vaulted over the fixed crossbar. Practitioners skilled in the vaulting art will understand that this reduced effort affords the vaulter athlete an ability to invoke a stiffer vaulting pole, i.e., a more rigid vaulting pole, and/or to use a longer vaulting pole than the vaulter athlete would otherwise be capable of using. Commensurate with the purposes of the present invention, this vaulting pole modification has enabled vaulter athletes to achieve higher pole vaults than would otherwise be feasible under like circumstances.

It will also be appreciated by those skilled in the art that the instant deviation or offset $\phi°$ from the center taught by the present invention, longitudinal axis of a vaulting pole inherently enables ergonomic emplacement of a vaulter athlete's hand for effectively and comfortably gripping a vaulting pole while the athlete is engaging in a pole vault competition. This inherent ergonomic emplacement of the vaulter athlete's hand and implicated wrist and forearm relative to the vaulting pole being securely handheld affords multiple surprising and unique benefits heretofore unknown in the art. Since the vaulter athlete's posture throughout the pole vaulting protocol and since the vaulter athlete must firmly grasp the vaulting pole under extreme force conditions, such ergonomic advantages are a surprising benefit of the present invention.

First, this inherent ergonomic hand-emplacement strengthens the handgrip of a vaulter athlete's fingers, and reduces stress upon, a vaulter athlete's wrist and contiguous forearm, and thereby tends to increase the vaulter athlete's ability to efficiently transfer kinetic energy engendered during the runup phase into potential energy stored in the vaulting pole during the planting phase. Second, it enhances the ability of the vaulter athlete to efficiently "pull" the vaulter athlete's body upwardly while disposed in an inverted position. Third, it enhances the ability of the vaulter athlete to efficiently "push" the vaulter athlete's body away from the vaulting pole during the vaulting phase, i.e., while the pole vault is being completed.

Thus, it should be clearly understood that this deviation in structure from the central, longitudinal axis of the vaulting pole accomplishes sixfold beneficial characteristics:

(1) increases the angle of the vaulting pole at plant or impact; (2) enables a more efficient transfer of kinetic energy derived by a vaulter athlete into potential energy stored in a vaulting pole; (3) enables a vaulter athlete to use a stiffer or more rigid vaulting pole; (4) enables a vaulter athlete to use a longer vaulting pole; (5) provides a more ergonomic hand grip with which to "pull" the vaulter athlete's weight upward along the pole vault pole axis when the vaulter athlete is situated in an inverted position; and (6) provides a more ergonomic grip in which a vaulter athlete can "push" implicated weight away from the vaulting pole once the vaulter athlete is being lifted upwardly.

The following is a tabulation of the components depicted in the drawings:

Components List

| # | Component | Comments |
|---|---|---|
| 10 | Conventional vaulting pole | Longitudinal Axis: A1-A2 |
| 50 | Vaulting pole of the present invention | Longitudinal Axis: A3-A4<br>Offset Axis: A5-A6 |
| 60 | Pole axial portion | |
| 70 | Pole offset portion | Offset angle Φ° |
| 80 | Screw Connector | Removably affixes Offset portion 70 to Axial Portion 60 |
| 100 | Right Hand | |
| 105 | Thumb | |
| 110 | Index Finger | |
| 115 | Middle Finger | |
| 120 | Ring Finger | |
| 125 | Little Finger | |
| 130 | Wrist | |
| 135 | Forearm | |

Other vaulting pole variations and modifications will, of course, become apparent from a consideration of the structures and techniques hereinbefore described and depicted. Accordingly, it should be clearly understood that the present invention is not intended to be limited by the particular features and structures hereinbefore described and depicted in the accompanying drawings, but that the present invention is to be measured by the scope of the appended claims.

What is claimed is:

1. A method for pole vaulting comprising the steps of:

holding a vaulting pole apparatus having a substantially straight longitudinal axis and a substantially straight offset axis, configured to be compatible with physical attributes, strength and sprint speed of a vaulter athlete, said vaulter athlete endeavoring to achieve a pole vault height greater than a vault height attainable by invoking a conventional straight vaulting pole;

sprinting down a runway while holding said vaulting pole apparatus;

planting said vaulting pole apparatus in a takeoff box disposed at an end of said runway; and engaging in a takeoff with an implicated takeoff angle directing said vaulting pole apparatus upwardly toward a horizontal crossbar positioned at a prescribed pole vault height and disposed upon a supporting structure;

said vaulting pole apparatus consisting of:

a substantially linear axial portion parallel to and congruent with said longitudinal axis;

an offset portion parallel to and congruent with said offset axis, and contiguous with and fixedly attached to said axial portion, and disposed at an acute offset angle deviating Φ° relative to said axial portion; and said takeoff angle functionally related to said acute offset angle and also selected to maximize conversion of kinetic energy engendered during said runway sprinting into potential energy stored in said axial portion of said vaulting pole apparatus during said takeoff, for enabling said vaulter athlete to vault upwardly substantially along said longitudinal axis of said vaulting pole apparatus to reach said greater vault height in excess of said preset height of said horizontal crossbar.

2. The vaulting pole apparatus recited in claim 1, wherein said axial portion comprises a substantially circular cross-section.

3. The vaulting pole apparatus recited in claim 1, wherein said offset portion comprises a substantially circular cross-section.

4. The vaulting pole apparatus recited in claim 1, wherein said offset angle Φ is more than 5° and less than 60°.

5. The vaulting pole apparatus recited in claim 1, wherein said offset angle Φ is more than 5° and less than 50°.

6. The vaulting pole apparatus recited in claim 1, wherein said offset angle Φ is more than 8° and less than 40°.

7. The vaulting pole apparatus recited in claim 1, wherein said offset angle Φ is more than 8° and less than 35°.

8. The vaulting pole apparatus recited in claim 1, wherein said offset angle Φ is more than 8° and less than 30°.

9. The vaulting pole apparatus recited in claim 1, wherein said offset angle Φ is more than 10° and less than 25°.

10. The vaulting pole apparatus recited in claim 1, wherein said offset angle Φ is more than 10° and less than 20°.

11. The vaulting pole apparatus recited in claim 1, wherein said offset angle Φ is more than 10° and less than 18°.

12. A vaulting pole apparatus having a substantially straight longitudinal axis and a substantially straight offset axis, configured to be compatible with physical attributes, strength and sprint speed of a vaulter athlete, said vaulter athlete endeavoring to achieve a pole vault height greater than a vault height attainable by invoking a conventional straight vaulting pole and by vaulting with a pole having greater length and greater stiffness than the length and stiffness of said conventional straight vaulting pole, and involving sequence of steps of sprinting down a runway while holding said vaulting pole apparatus, planting said vaulting pole apparatus in a takeoff box disposed at an end of said runway, and engaging in a takeoff with an implicated takeoff angle directing said vaulting pole apparatus upwardly toward a horizontal crossbar positioned at a prescribed pole vault height and disposed upon a supporting structure, said vaulting pole apparatus consisting of:

a substantially linear axial portion parallel to and congruent with said longitudinal axis;

an offset portion parallel to and congruent with said offset axis, and contiguous with and fixedly attached to said axial portion, and disposed at an acute offset angle deviating Φ° relative to said axial portion; and said takeoff angle functionally related to said acute offset angle and also selected to maximize said length and said stiffness of said linear axial portion of said vaulting pole apparatus commensurate with said physical attributes and said strength of said vaulter athlete, for enabling said vaulter athlete to vault upwardly substantially along said longitudinal axis of said vaulting pole apparatus to reach said greater vault height in excess of said preset height of said horizontal crossbar.

13. The vaulting pole apparatus recited in claim 12, wherein said axial portion comprises a substantially circular cross-section.

14. The vaulting pole apparatus recited in claim 12, wherein said offset portion comprises a substantially circular cross-section.

15. The vaulting pole apparatus recited in claim 12, wherein said offset angle Φ is more than 5° and less than 60°.

16. The vaulting pole apparatus recited in claim 12, wherein said offset angle Φ is more than 5° and less than 50°.

17. The vaulting pole apparatus recited in claim 12, wherein said offset angle Φ is more than 8° and less than 40°.

18. The vaulting pole apparatus recited in claim 12, wherein said offset angle Φ is more than 8° and less than 35°.

19. The vaulting pole apparatus recited in claim 12, wherein said offset angle Φ is more than 8° and less than 30°.

20. The vaulting pole apparatus recited in claim 12, wherein said offset angle Φ is more than 10° and less than 25°.

21. The vaulting pole apparatus recited in claim 12, wherein said offset angle Φ is more than 10° and less than 20°.

22. The vaulting pole apparatus recited in claim 12, wherein said offset angle Φ is more than 10° and less than 18°.

* * * * *